US010597966B2

(12) United States Patent
Jones et al.

(10) Patent No.: US 10,597,966 B2
(45) Date of Patent: Mar. 24, 2020

(54) BLOWOUT PREVENTER APPARATUS AND METHOD

(71) Applicant: CAMERON INTERNATIONAL CORPORATION, Houston, TX (US)

(72) Inventors: Oscar B. Jones, Houston, TX (US); Nicolas J. Arteaga, Jersey Village, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 15/206,017

(22) Filed: Jul. 8, 2016

(65) Prior Publication Data

US 2018/0010410 A1 Jan. 11, 2018

(51) Int. Cl.
*E21B 33/06* (2006.01)

(52) U.S. Cl.
CPC ..... *E21B 33/06* (2013.01)

(58) Field of Classification Search
USPC ..... 251/1.2–1.4
See application file for complete search history.

(56) References Cited

U.S. PATENT DOCUMENTS 2,846,178 A * 8/1958 Minor ..... E21B 33/06 166/80.1
3,050,132 A * 8/1962 Page ..... E21B 34/08 137/460
3,561,723 A * 2/1971 Cugini ..... E21B 33/064 251/1.2
3,667,721 A * 6/1972 Vujasinovic ..... E21B 33/06 251/1.1
4,153,278 A * 5/1979 Ahlstone ..... F16L 27/06 285/146.3
4,602,794 A * 7/1986 Schaeper ..... E21B 33/06 251/1.2
5,588,491 A * 12/1996 Brugman ..... E21B 33/085 166/383
7,409,988 B2 * 8/2008 Borden ..... E21B 33/06 166/84.1
8,424,607 B2 * 4/2013 Springett ..... E21B 33/063 166/298
2016/0076312 A1 * 3/2016 Fraczek ..... E21B 19/002 166/367

OTHER PUBLICATIONS

T-84 Low Pressure Annular BOP Brochure, Cameron International Corporation, 2016, 2 pages.
GK® 11"-5000 PSI Annular Blowout Preventer Operator's Manual, Hydril Company LP, 2007, 66 pages.

* cited by examiner

*Primary Examiner* — Jessica Cahill
*Assistant Examiner* — Daphne M Barry
(74) *Attorney, Agent, or Firm* — Helene Raybaud

(57) ABSTRACT

An annular elastomeric packer for a blowout preventer includes a plurality of circumferentially spaced inserts, wherein at least one of the plurality of inserts includes an upper flange extending between a radially inner end and a radially outer end, a lower flange extending between a radially inner end and a radially outer end, and a rib extending between the upper flange and the lower flange, wherein the upper flange includes an upper surface disposed at an acute angle relative a longitudinal axis of the elastomeric packer, and an elastomeric body coupled to the plurality of inserts and including an inner sealing surface.

11 Claims, 9 Drawing Sheets

BLOWOUT PREVENTER APPARATUS AND METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling systems utilize drilling fluid or mud for drilling a wellbore in a subterranean earthen formation. In some offshore applications, a blowout preventer (BOP) is installed at a subsea wellhead that extends from the sea floor, where the BOP is configured to control the inlet and outlet of fluid from a wellbore extending into a subterranean earthen formation below the sea floor, and particularly, to confine well fluid in the wellbore in response to a "kick" or rapid influx of formation fluid into the wellbore. An individual BOP stack may include both ram BOPs and annular BOPs. Ram BOPs include one or more rams that extend towards the center of the wellbore upon actuation to restrict flow through the ram BOP. In some applications, the inner sealing surface of each ram of the ram BOP is fitted with an elastomeric packer for sealing the wellbore. Annular BOPs are configured to close or seal against the outer surface of a drill string extending through the BOP stack. Annular BOPs generally include an annular elastomeric packer engaged by a piston, where upon actuation the annular packer is constricted about the drill string in response to displacement of the piston. In some applications, the sealing integrity between the packer and the drill pipe may be reduced in response to the flow or extrusion of the elastomeric material forming the packer in response to actuation of the annular BOP into the closed position.

SUMMARY

An embodiment of a annular elastomeric packer for a blowout preventer comprises a plurality of circumferentially spaced inserts, wherein at least one of the plurality of inserts comprises an upper flange extending between a radially inner end and a radially outer end, a lower flange extending between a radially inner end and a radially outer end, and a rib extending between the upper flange and the lower flange, wherein the upper flange comprises an upper surface disposed at an acute angle relative a longitudinal axis of the elastomeric packer, and an elastomeric body coupled to the plurality of inserts and comprising an inner sealing surface. In some embodiments, the upper flange of the insert comprises a lower end, and wherein the radially inner end of the upper flange comprises a curved surface extending between the upper end and the lower end of the upper flange. In some embodiments, the upper flange of the insert comprises a longitudinal axis disposed at an acute angle relative to the longitudinal axis of the elastomeric packer. In certain embodiments, the lower flange of the insert comprises a longitudinal axis, and wherein the longitudinal axis of the upper flange is disposed at an angle relative the longitudinal axis of the lower flange. In certain embodiments, the upper surface of the upper flange of the insert is planar.

An embodiment of a blowout preventer comprises a housing comprising a bore extending therein, an annular wear plate coupled to the housing, an annular piston slidably disposed in the bore of the housing and comprising an inner surface, and an annular elastomeric packer disposed in the bore of the housing and in physical engagement with the inner surface of the piston, wherein the elastomeric packer comprises a plurality of circumferentially spaced inserts coupled to an elastomeric body, wherein the blowout preventer comprises a first position providing fluid communication through the bore of the housing, and a second position restricting fluid communication through the bore of the housing, wherein, in response to actuating the blowout preventer between the first and second positions, at least one of the plurality of inserts of the elastomeric packer pivots about an axis of rotation. In some embodiments, the wear plate comprises an annular curved surface. In some embodiments, the wear plate comprises a radially inner end and a radially outer end, and wherein the curved surface of the wear plate curves between the radially inner and outer ends. In certain embodiments, when the blowout preventer is disposed in the second position, an angled engagement interface is formed between the insert of the elastomeric packer and the curved surface of the wear plate. In certain embodiments, when the blowout preventer is disposed in the second position, engagement between the wear plate and the insert applies a torque against the insert about the axis of rotation. In some embodiments, when the blowout preventer is disposed in the second position, a radial gap extends between an outer end of the insert and the inner surface of the piston. In some embodiments, the blowout preventer further comprises a tubular member extending through the bore of the housing, wherein, when the blowout preventer is disposed in the second position, a radially inner end of the insert contacts an outer surface of the tubular member. In certain embodiments, when the blowout preventer is disposed in the second position an inner surface of the elastomeric packer sealingly engages the outer surface of the tubular member and a sealing pressure applied to the outer surface of the tubular member by the inner surface of the packer is increased in response to an increase in fluid pressure in the bore of the housing. In certain embodiments, at least one of the plurality of inserts of the elastomeric packer comprises an upper flange extending between a radially inner end and a radially outer end, a lower flange extending between a radially inner end and a radially outer end, and a rib extending between the upper flange and the lower flange. In some embodiments, the upper flange comprises an upper surface disposed at an acute angle relative a longitudinal axis of the elastomeric packer. In some embodiments, the upper flange of the insert comprises an upper end and a lower end, and wherein the radially inner end of the upper flange comprises a curved surface extending between the upper end and the lower end of the upper flange. In certain embodiments, the upper flange of the insert comprises a longitudinal axis disposed at an acute angle relative to the longitudinal axis of the elastomeric packer.

An embodiment of a method of actuating a blowout preventer, comprises actuating the blowout preventer from a first position providing fluid communication through a bore of the blowout preventer, to a second position restricting fluid communication through the bore of the blowout preventer, and pivoting an insert of an elastomeric packer of the blowout preventer about an axis of rotation in response to actuating the blowout preventer from the first position to the second position. In some embodiments, the method further comprises applying a torque to an upper end of the insert in response to contacting the insert with a wear plate of the blowout preventer. In some embodiments, the method further comprises engaging an upper end of the insert with a wear plate of the blowout preventer at an angled engagement interface disposed between the wear plate and the insert.

BRIEF DESCRIPTION OF THE DRAWINGS

For a detailed description of exemplary embodiments, reference will now be made to the accompanying drawings in which.

DETAILED DESCRIPTION

Figure 1:
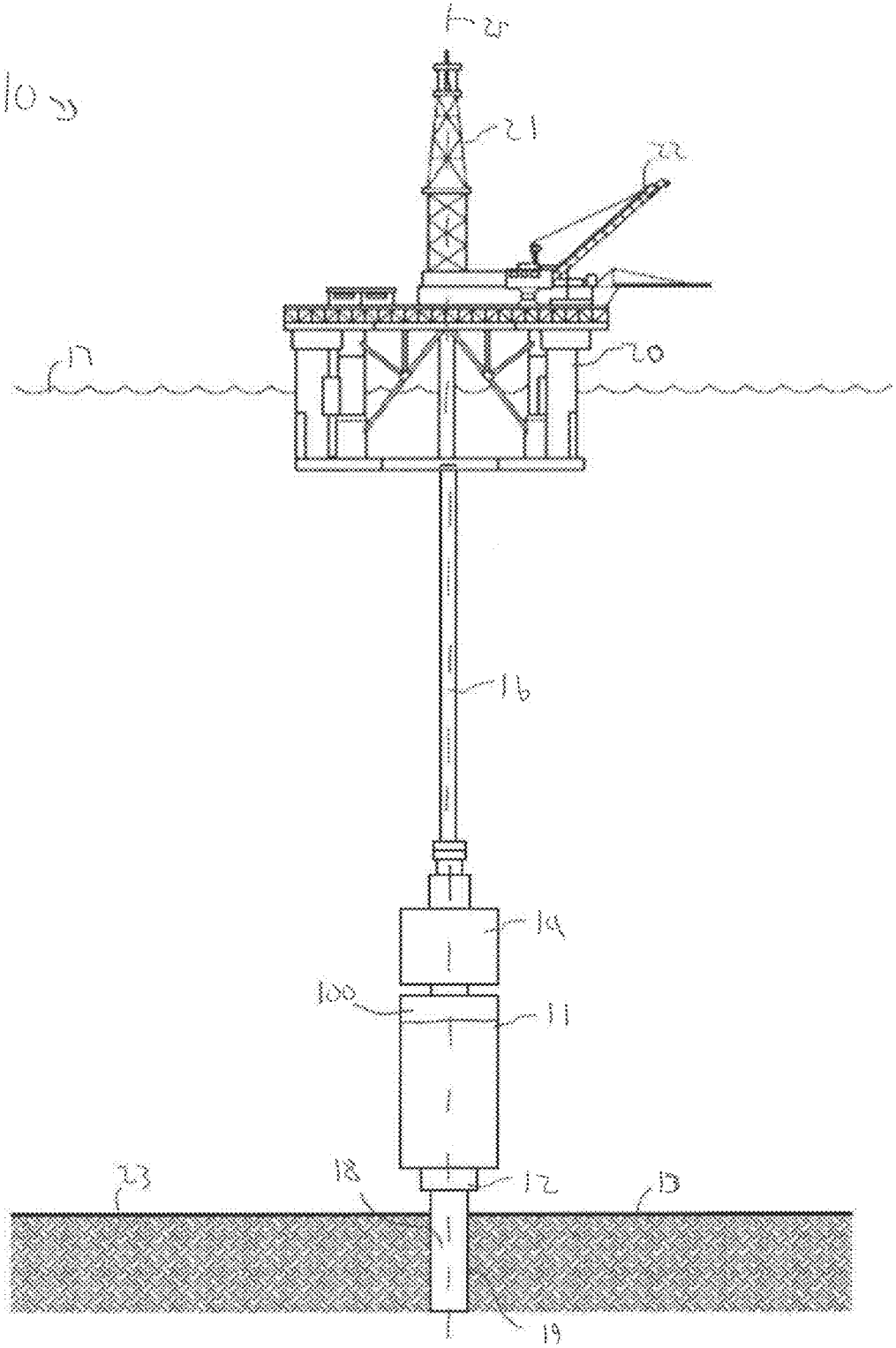
FIG. 1 is a schematic view of an embodiment of a well system including a BOP in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, an embodiment of an offshore system 10 for drilling and/or producing a subsea well is shown. In this embodiment, system 10 includes a subsea blowout preventer (BOP) stack 11 mounted to a wellhead 12 disposed at the sea floor 13. Stack 11 includes an annular BOP 100 at an upper end thereof, which is coupled to a lower marine riser package (LMRP) 14. A marine riser 16 extends from a surface vessel 20 at the sea surface or waterline 17 to LMRP 14. In this embodiment, vessel 20 is a floating platform, and thus, may also be referred to as platform 20. In other embodiments, the vessel (e.g., vessel 20) can be a drill ship or any other vessel disposed at the sea surface for conducting offshore drilling and/or production operations.

In this embodiment, platform 20 includes a drilling derrick 21 and a lifting device 22. Riser 16 of well system 10 comprises a large-diameter pipe that connects LMRP 14 to floating platform 20. In addition, riser 16 is coupled to electrical and hydraulic lines (not shown) for powering and controlling the actuation of components of BOP stack 11. A primary conductor 18 of system 10 extends from wellhead 12 into a wellbore 19 extending into a subterranean earthen formation 23. BOP stack 11, LMRP 14, wellhead 12, and conductor 18 are arranged such that each shares a common central or longitudinal axis 25. In other words, BOP stack 11, LMRP 14, wellhead 12, and conductor 18 are coaxially aligned. Additionally, BOP stack 11, LMRP 14, wellhead 12, and conductor 18 are vertically stacked one-above-the-other, and the position of platform 20 is controlled such that axis 25 is vertically or substantially vertically oriented.

During operation of well system 10, a tubular member, such as a drill string, extends from platform 20 to wellbore 19 via an internal bore of riser 16, LMRP 14, stack 11, and wellhead 12, where the dill string includes a drill bit coupled to a lower end thereof and disposed in the wellbore 19. Particularly, drilling fluid is pumped from platform 20 and into wellbore 19 via ports disposed in the drill bit. From wellbore 19, the drilling fluid is recirculated to platform 20 via an annulus 35 extending between the drill string and riser 16, LMRP 14, BOP stack 11, and wellhead 12. During operation of well system 10, it may become necessary to fluidically isolate wellbore 19 from the surrounding environment, such as in the case of an uncontrolled influx of fluid into wellbore 19 from the subterranean earthen formation 23. In such an event, BOP stack 11, including annular BOP 100, are configured to restrict fluid communication between wellbore 19 and the surrounding environment, including the internal bores of riser 16 and LMRP 14. In certain embodiments, annular BOP 100 is actuated from an open position to a closed position sealing against the drill pipe in response to an uncontrolled influx of fluid into wellbore 19 from formation 23.

Figure 2:
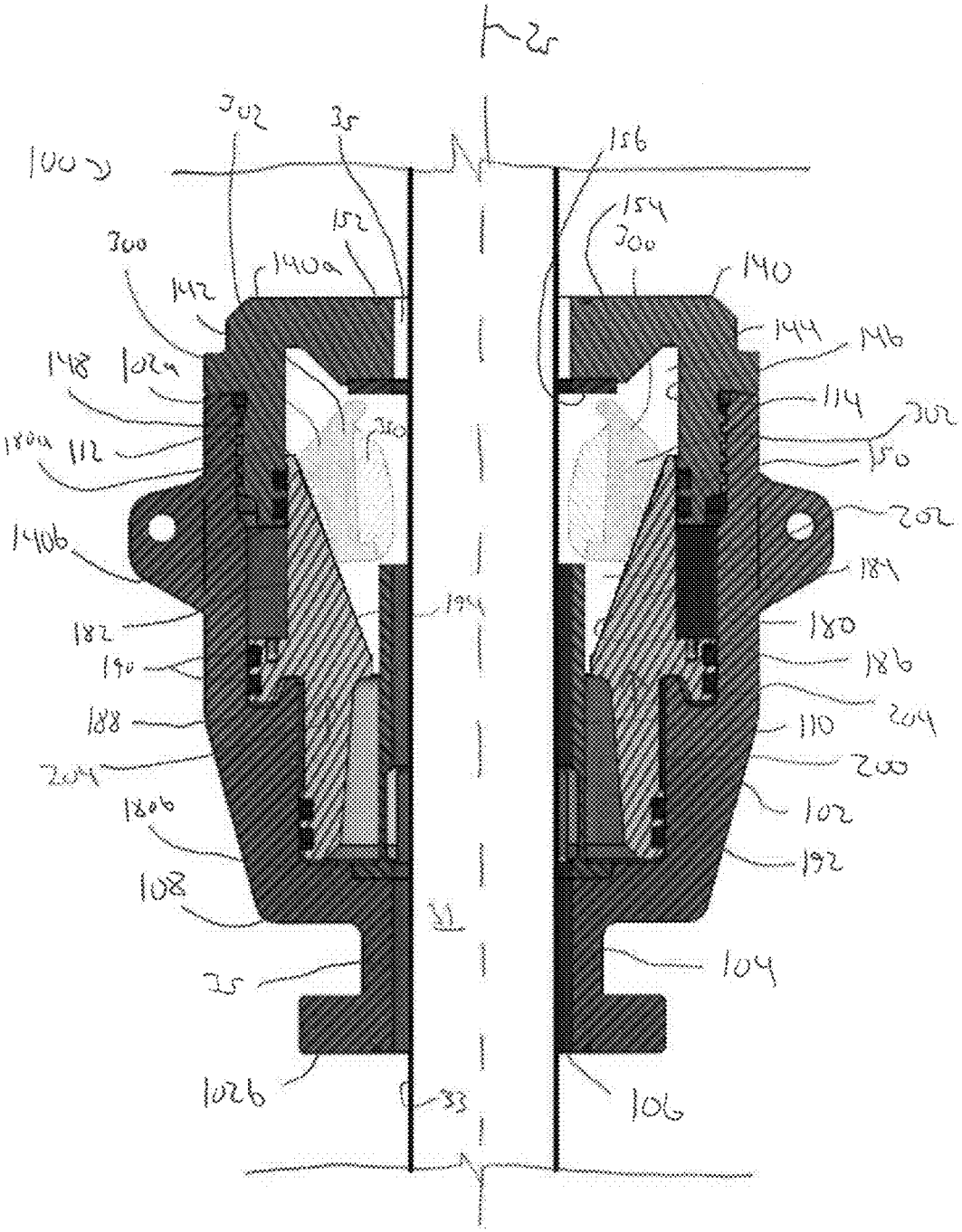
FIG. 2 is a schematic, cross-sectional view of the BOP of the well system of FIG. 1 in accordance with principles disclosed herein.
Figure 3:
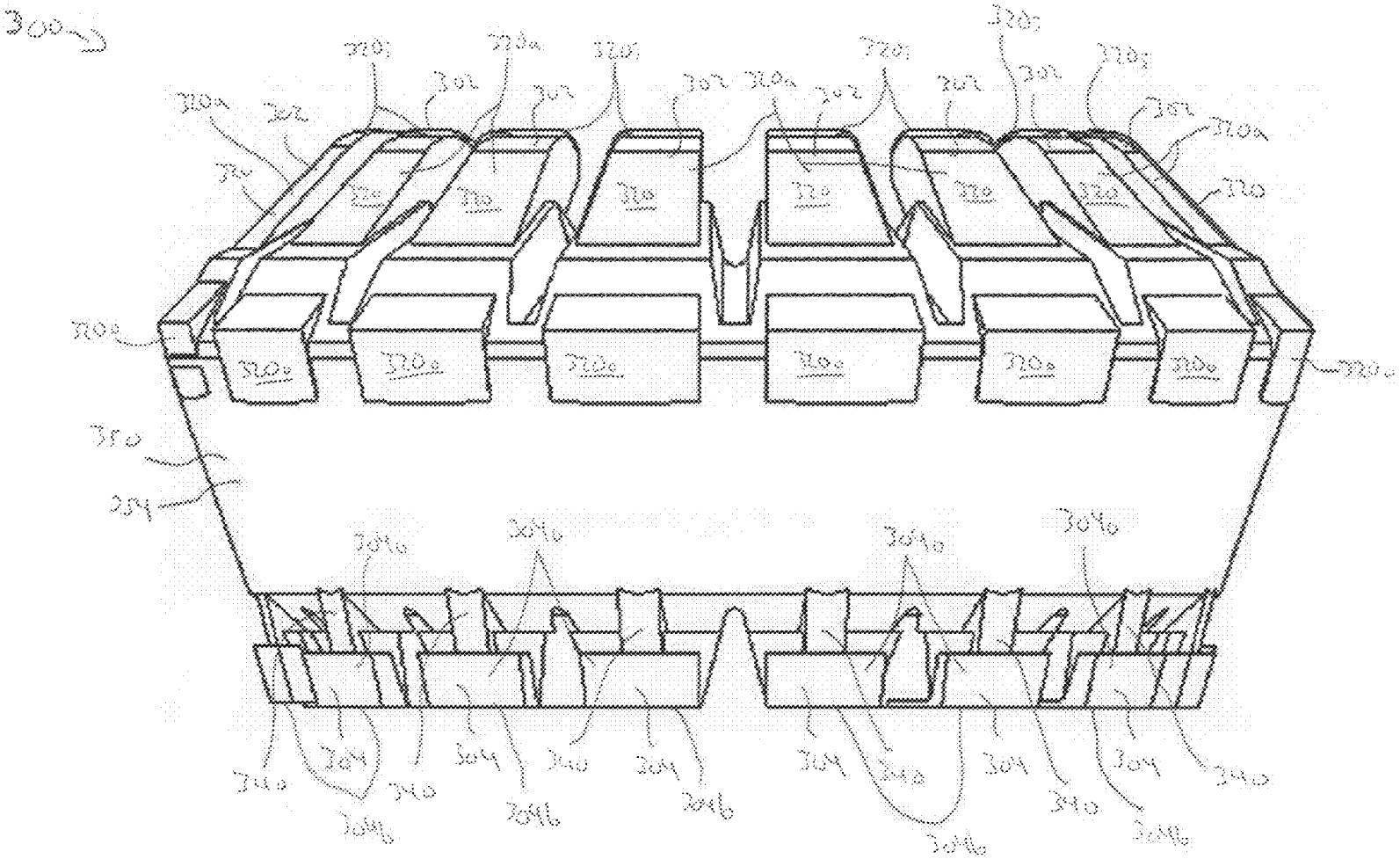
FIG. 3 is a side view of an embodiment of an elastomeric packer of the BOP of FIG. 2 in accordance with principles disclosed herein.
Figure 4:
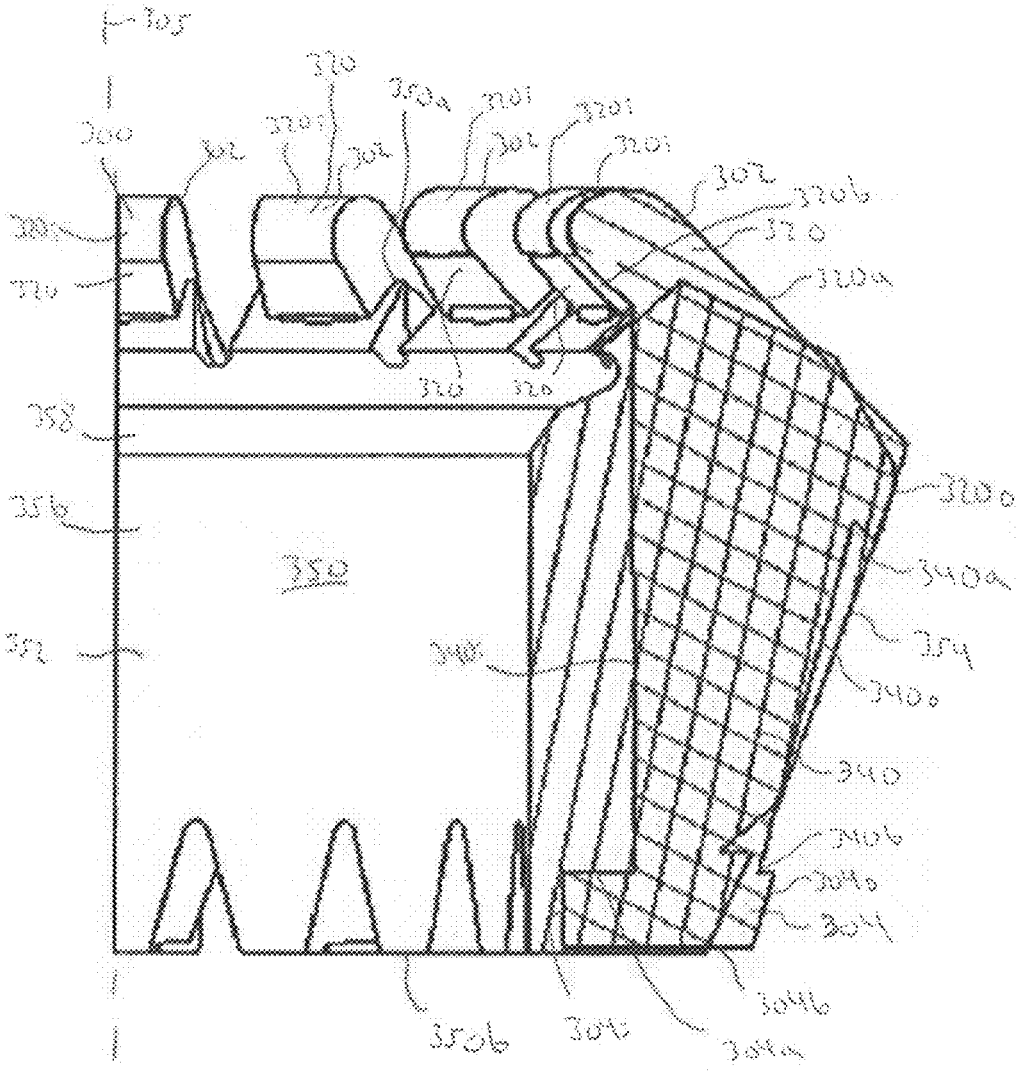
FIG. 4 is a cross-sectional view of the packer of FIG. 3.
Figure 5:
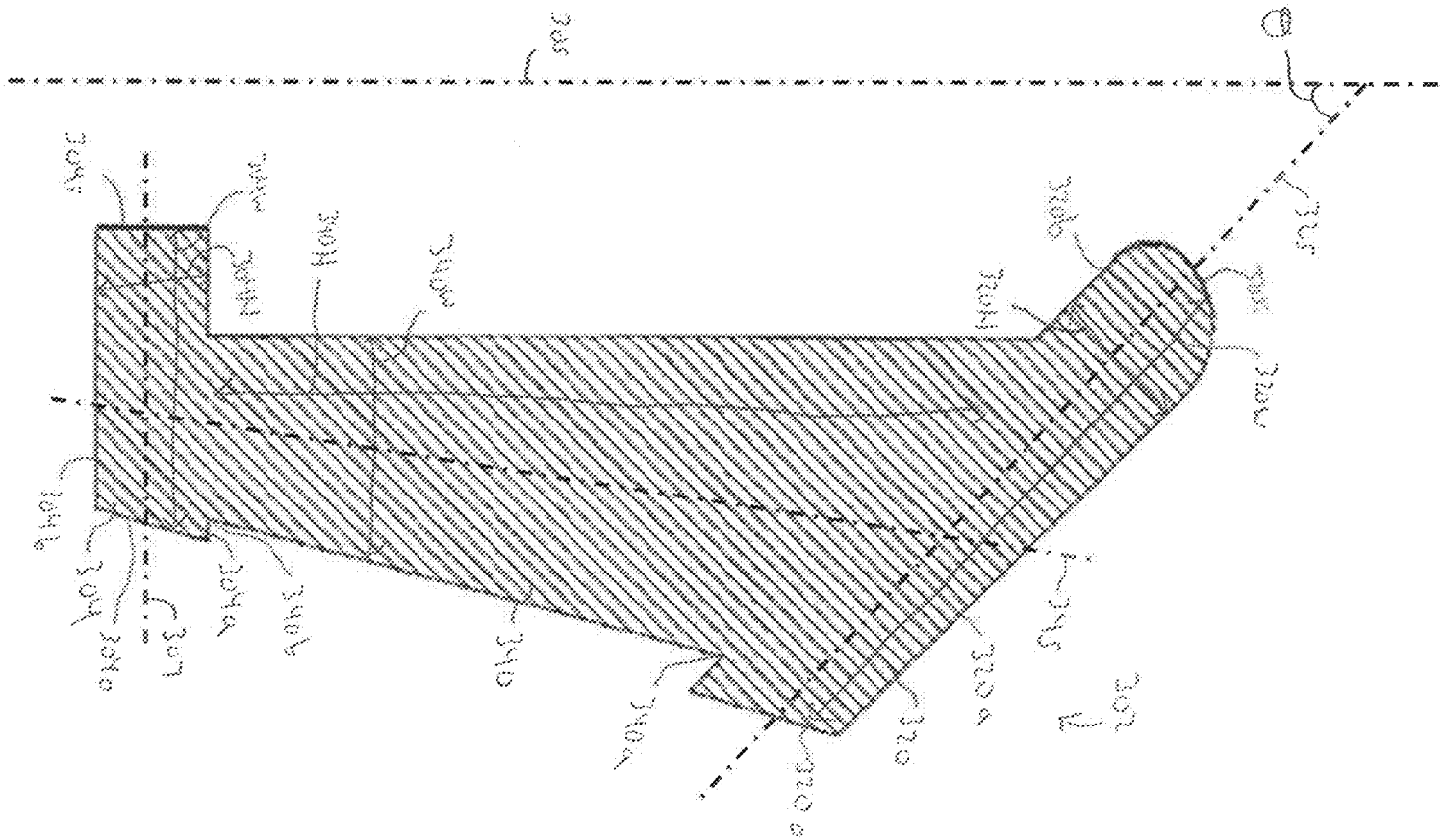
FIG. 5 is a side cross-sectional view of an embodiment of an insert of the packer of FIG. 3 in accordance with principles disclosed herein.

Referring to FIG. 2, a schematic, cross-sectional view of annular BOP 100 of the well system 10 is shown. Given that FIG. 2 is a schematic illustration of BOP 100, BOP 100 may include additional components or features not shown in FIG. 2. Further, while BOP 100 is shown as part of well system 10, BOP 100 may be utilized in other well systems, including land-based well systems. In the embodiment shown in FIG. 2, annular BOP 100 has a central or longitudinal axis coaxial with longitudinal axis 25 and generally includes a housing 102, a top 140, a piston 180, and an elastomeric packer 300. Housing 102 is configured to receive piston 180 and has a first or upper end 102*a*, a second or lower end 102*b*, and a central bore 104 extending between ends 102*a* and 102*b* and defined by an inner surface 106. In this embodiment, the inner surface 106 of bore 104 includes a radially extending annular shoulder 108 that receives and couples with a lower end of an axially extending, generally cylindrical mandrel 110 disposed in bore 104. The inner surface 106 of housing 102 also includes a threaded coupler 112 disposed thereon and an annular seal 114 disposed therein, where both coupler 112 and annular seal 114 are disposed proximal the upper end 102*a* of housing 102.

Top 140 of annular BOP 100 releasably couples to the upper end 102*a* of housing 102 for housing piston 180 and elastomeric packer 300 therein. Although in this embodiment annular BOP 100 includes top 140 releasably coupled to a housing 102, in other embodiments, housing 102 and top 140 may comprise a single, unitary component. In the embodiment shown in FIG. 2, top 140 has a first or upper end 140*a*, a second or lower end 140*b*, an outer surface 142 extending between ends 140*a* and 140*b*, and a central bore 144 extending between ends 140*a* and 140*b* and defined by an inner surface 146. The outer surface 142 of top 140 includes a threaded coupler 148 for threadably connecting with coupler 112 of housing 102. When top 140 is connected with housing 102 (as shown in FIG. 2) the annular seal 114 of housing 102 sealingly engages the outer surface 142 of top 140. In the embodiment shown, the inner surface 146 of the bore 144 of top 140 includes a pair of annular seals 150 disposed proximal lower end 140*b* for sealing against piston 180. In addition, inner surface 146 includes a radially extending annular surface 152 proximal upper end 140*a* of top 140, which receives and couples with an annular wear plate 154. Wear plate 154 is configured to physically engage packer 300 in response to the actuation of annular BOP 100, thereby acting sacrificially to protect top 140 from wear during operation of BOP 100. As will be discussed further herein, wear plate 154 includes a lower annular surface 156 and is configured to physically engage and guide the displacement of elastomeric packer 300 as annular BOP 100 is actuated between an open position (shown in FIG. 2), and a closed position. In some embodiments, wear plate 154 may be incorporated with top 140 to form a single unitary member.

Piston 180 of annular BOP 100 is slidably disposed within the bore 104 of housing 102 and is configured to actuate BOP 100 between the open and closed positions in response to the communication of fluid pressure to bore 104 from hydraulic pressure sources (e.g., hydraulic accumulators, bottles, etc.) disposed either proximal BOP stack 11 or from platform 20. In the embodiment shown in FIG. 2, piston 180 has a first or upper end 180*a*, a second or lower end 180*b*, an outer surface 182 extending between ends 180*a* and 180*b*, and a central bore 184 extending between ends 180*a* and 180*b* and defined by an inner surface 186. Outer surface 182 of piston 180 includes a radially outwards extending flange 188 and a pair of first or upper annular seals 190 disposed therein, where upper seals 190 sealingly engage the inner surface 106 of the bore 104 of housing 102. Additionally, the outer surface 182 of piston 180 includes a pair of second or lower annular seals 192 disposed proximal lower end 180*b* and similarly configured to sealingly engage the inner surface 106 of housing 102.

In the embodiment shown in FIG. 2, the inner surface 186 of piston 180 includes an inclined or angled section 194 (i.e., disposed at a non-orthogonal angle relative longitudinal axis 25) extending axially from upper end 180*a*, where inclined surface 194 physically engages the elastomeric packer 300. Particularly, inclined surface 194 is disposed at an acute angle relative longitudinal axis 25. As will be discussed further herein, inclined surface 194 is configured to translate an axially directed force against piston 180 provided by hydraulic pressure within bore 104 of housing 102 into a radially directed force against packer 300 for sealing against an outer surface 33 of a tubular member or drill pipe 31 extending through the bore 104 of housing 102. As shown in FIG. 2, mandrel 110 is configured to protect or guard piston 180 from drill pipe 31, especially if drill pipe 31 becomes angularly misaligned with the longitudinal axis 25 of annular BOP 100.

In the arrangement shown in FIG. 2, the sealing engagement provided by upper annular seals 190 and lower annular seals 192 of piston 180 define an annular first or closing chamber 200 within bore 104 of housing 102 that extends axially between seals 190 and 192. Additionally, the annular seals 150 of top 140 sealingly engage the outer surface 182 of piston 180. Sealing engagement provided by seals 150 of top 140 and the upper seals 190 of piston 180 define an annular second or opening chamber 202 within bore 104 of housing 102 that extends axially between seals 150 and 190. Annular BOP 100 is shown in the open position in FIG. 2, where fluid communication is allowed or provided through bore 104 of housing 102 and bore 144 of top 140. Particularly, in the open position, fluid may be communicated axially along an annulus extending radially between the outer surface 33 of drill pipe 31 and the inner surface 106 of the bore 104 of housing 102 and the inner surface 146 of the bore 144 of top 140. In this arrangement, fluid may be recirculated from the wellbore 19 (shown in FIG. 1) to the platform 20 via riser 16.

Annular BOP 100 may be actuated from the open position shown in FIG. 2 to a closed position where fluid communication through annulus 35 is restricted via sealing engagement between packer 300 and the outer surface 33 of drill pipe 31. Specifically, to actuate annular BOP 100 to the closed position closing chamber 200 of bore 104 is hydraulically pressurized while hydraulic pressure within opening chamber 202 is concurrently reduced, thereby providing a hydraulic pressure closing force against piston 180 (shown schematically by arrow 204). Closing force 204 is axially directed towards the upper end 140*a* of top 140, causing piston 180 to be displaced axially upwards within bore 140 until annular BOP 100 is disposed in the closed position. Conversely, annular BOP 100 may be actuated from the closed position to the open position shown in FIG. 2 by hydraulically pressurizing opening chamber 202 while concurrently depressurizing closing chamber 200. The pressurization of opening chamber 202 and depressurization of closing chamber 200 provides an axially directed opening force against piston 180, causing piston 180 to be displaced through bore 104 of housing 102 until annular BOP 100 is disposed in the open position with the lower end 180*b* in physical engagement with or disposed directly adjacent the annular surface 108 of housing 102. Fluid pressure may be communicated to chambers 200 and 202 via ports (not shown) extending radially through housing 102, where each port is in fluid communication with a hydraulic pressure source, such as a subsea pressure source or one provided at the platform 20.

Referring to FIGS. 2-5, elastomeric packer 300 (shown schematically in FIG. 2) is configured to sealingly engage the outer surface 33 of drill pipe 31 when annular BOP 100 is actuated into the closed position. In certain embodiments, packer 300 is configured to seal bore 144 of top 140 and bore 104 of housing 102 when there is no drill pipe 31 extending through bore 144 and BOP 100 is actuated into the closed position. In other words, when drill pipe 31 (or any other tubular member) does not extend through annular BOP 100, packer 300 is configured to seal against itself to thereby restrict fluid communication through bore 144 of top 140 when BOP 100 is in the closed position.

In the embodiment shown in FIGS. 2-5, packer 300 has a central or longitudinal axis 305 and generally includes a plurality of circumferentially spaced inserts 302 coupled to an elastomeric body 350. In certain embodiments, inserts 302 comprise a metallic material and are circumferentially arranged in a mold such that elastomeric body 350 may be molded thereto to form elastomeric packer 300. Each insert 302 of packer 300 includes a lower flange member 304, an upper flange member 320, and a rib member 340 extending between and coupling the lower and upper flange members 304 and 320 (shown particularly in FIG. 5). Lower flange 304 provides structural support to packer 300 and has a first or upper end 304*a*, and a second or lower end 304*b* defining a lower end of insert 302. Additionally, lower flange 304 has a central or longitudinal axis 307 extending between a radially inner end 304*i* and a radially outer end 304*o*, where longitudinal axis 307 is disposed substantially orthogonal to longitudinal axis 305 of packer 305. In this configuration, lower flange 304 has a width 304W extending between inner end 304*i* and outer end 304*o* that is greater than a height 304H extending between upper end 304*a* and lower end 304*b*.

The upper flange 320 of each insert 302 provides additional structural support to packer 300 and is configured to rotate or pivot the insert 302 in response to the actuation of annular BOP 100 between the open and closed positions. In the embodiment shown in FIGS. 2-5, upper flange 320 includes a first or upper end 320*a* defining an upper end of insert 302, and a second or lower end 320*b*. In addition, upper flange 320 includes a central or longitudinal axis 325 extending between a radially inner end 320*i* and a radially outer end 320*o* of upper flange 320. In this configuration, upper flange 320 has a width 320W extending between radially inner end 320*i* and radially outer end 320*o* that is greater than a height 320H of upper flange 320 that extends between upper end 320*a* and lower end 320*b*. In this embodiment, longitudinal axis 325 is disposed at an angle θ (shown in FIG. 5) relative longitudinal axis 305 of packer 300. In certain embodiments, the angle θ between axis 325 of upper flange 320 and axis 305 of packer 300 is approximately between 20°-80°; however, in other embodiments, angle θ between axis 325 of upper flange 320 and axis 305 of packer 300 may comprise varying angles. Further, longitudinal axis 325 of upper flange 320 is disposed at an acute angle relative the longitudinal axis 307 of lower flange 304.

In the embodiment shown, the upper end 320*a* of upper flange 320 comprises an upper inclined or angled (i.e., disposed at a non-orthogonal angle relative longitudinal axis 305) surface 320*a* extending along a plane disposed parallel with longitudinal axis 325 of upper flange 320. In other words, upper inclined surface 320*a* of upper flange 320, which extends between inner end 320*a* and outer end 320*o*, is also disposed at angle θ relative longitudinal axis 305 of packer 300. In this embodiment, upper surface 320*a* comprises a flat or planar surface. Additionally, the radially inner end 320*i* of upper flange 320 comprises a curved inner surface 320*i* extending between upper end 320*a* and lower end 320*b*. In certain embodiments, curved inner surface 320*i* of upper flange 320 has a constant or substantially constant radius of curvature as surface 320*i* extends between upper end 320*a* and lower end 320*b*. However, in other embodiments, curved inner surface 320*i* may include a variable radius of curvature as surface 320*i* extends between upper end 320*a* and lower end 320*b*. In still further embodiments, inner surface 320*i* comprises a plurality of discrete angled surfaces disposed at acute angles relative each other in lieu of a continuous curved surface.

The rib 340 of each insert 302 has a first or upper end 340*a*, a second or lower end 340*b*, and a central or longitudinal axis 345 extending between upper end 340*a* and lower end 340*b*. In this configuration, upper end 340*a* couples with the lower end 320*b* of upper flange 320 and the lower end 340*b* couples with the upper end 304*a* of lower flange 304. While insert 302 is shown in FIGS. 2-5 as comprising a single unitary member or body, in other embodiments, lower flange 304, upper flange 320, and rib 340 may comprise separate or distinct members or bodies. In the embodiment shown in FIGS. 2-5, longitudinal axis 345 of rib 340 is disposed at an acute angle relative the longitudinal axis 305 of packer 300; however, in other embodiments, the longitudinal axis 345 of rib 340 may extend parallel with longitudinal axis 305 of packer 300. Additionally, in this embodiment rib 340 includes a height 340H extending between upper end 340*a* and lower end 340*b* that is greater than a width 340W that extends between a radially inner end 340*i* and a radially outer end 340*o* of rib 340. Thus, while lower flange 304 and upper flange 320 each include a width greater than a respective height, rib 340 conversely includes a height greater than a respective width.

The inserts 302 of elastomeric packer 300 are configured to provide structural integrity to packer 300, and to control the deformation of elastomeric 350 when annular BOP 100 is actuated between the open and closed positions. Elastomeric body 350 of packer 300 is configured to sealingly engage the outer surface 33 of drill string 31 and the inclined surface 194 of piston 180 to restrict fluid communication either through annulus 35 (if a tubular member is present in annular BOP 100) or bore 144 of top 140 when annular BOP 100 is disposed in the closed position. As shown particularly in FIG. 4, elastomeric body 350 comprises an annular or torus shaped body having an upper 350*a*, a lower end 350*b*, a radially inner sealing surface 352 extending between ends 350*a* and 350*b*, and a radially outer sealing surface 354 extending between ends 350*a* and 350*b*.

In the embodiment shown in FIGS. 2-5, the inner surface 352 of elastomeric body 350 includes a cylindrical surface or section 356 that extends along a cylindrical plane having a central or longitudinal axis parallel or coaxial with longitudinal axis 305 of packer 300. Inner surface 352 of elastomeric body 350 also includes an annular angled or inclined surface 358 extending axially from an upper end of cylindrical surface 356. In this embodiment, inclined surface 358 of elastomeric body 350 is disposed at an angle relative longitudinal axis 305 of packer 300 when annular BOP 100 is disposed in the open position. As will be discussed further herein, inclined surface 358 of elastomeric body 350 is rotated or pivoted towards the outer surface 33 of drill pipe 31 when annular BOP 100 is actuated into the closed position such that inclined surface 358 is disposed substantially parallel with the longitudinal axis 305 of packer 300, which is in-turn disposed substantially coaxial with a longitudinal axis of drill pipe 31. In the embodiment of FIGS. 2-5, the outer surface 354 of elastomeric body 350 is also disposed at an angle relative longitudinal axis 305 of packer 300. Particularly, outer surface 354 extends along a conical plane that is disposed parallel with a conical plane upon which the inclined surface 194 of piston 180 extends. In other words, outer surface 354 is disposed parallel with inclined surface 194, each surface 354 and 194 being disposed at a similar angle relative longitudinal axis 305 of packer 300 and longitudinal axis 25 of annular BOP 100.

Figure 6:
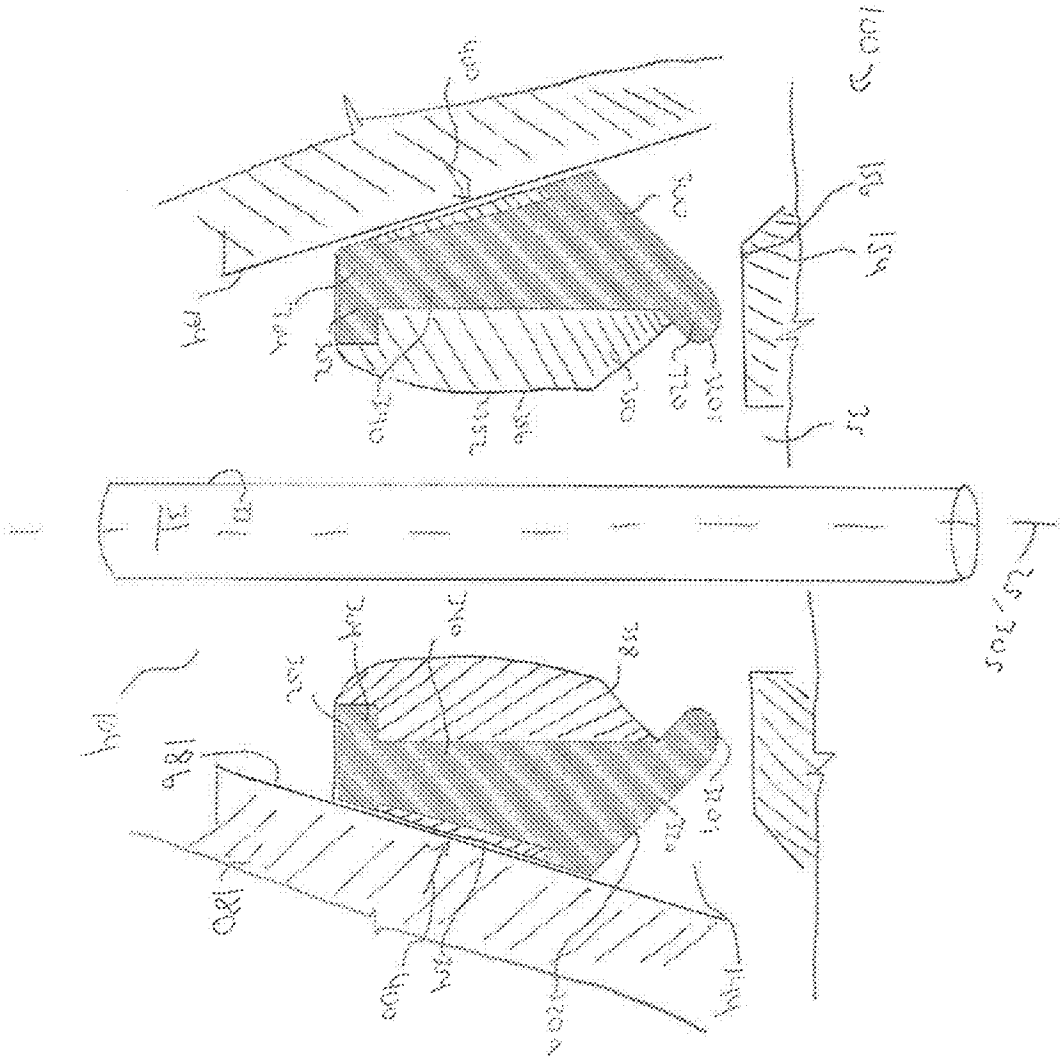
FIG. 6 is a schematic, cross-sectional view of the BOP of FIG. 2 disposed in a first position.
Figure 7:
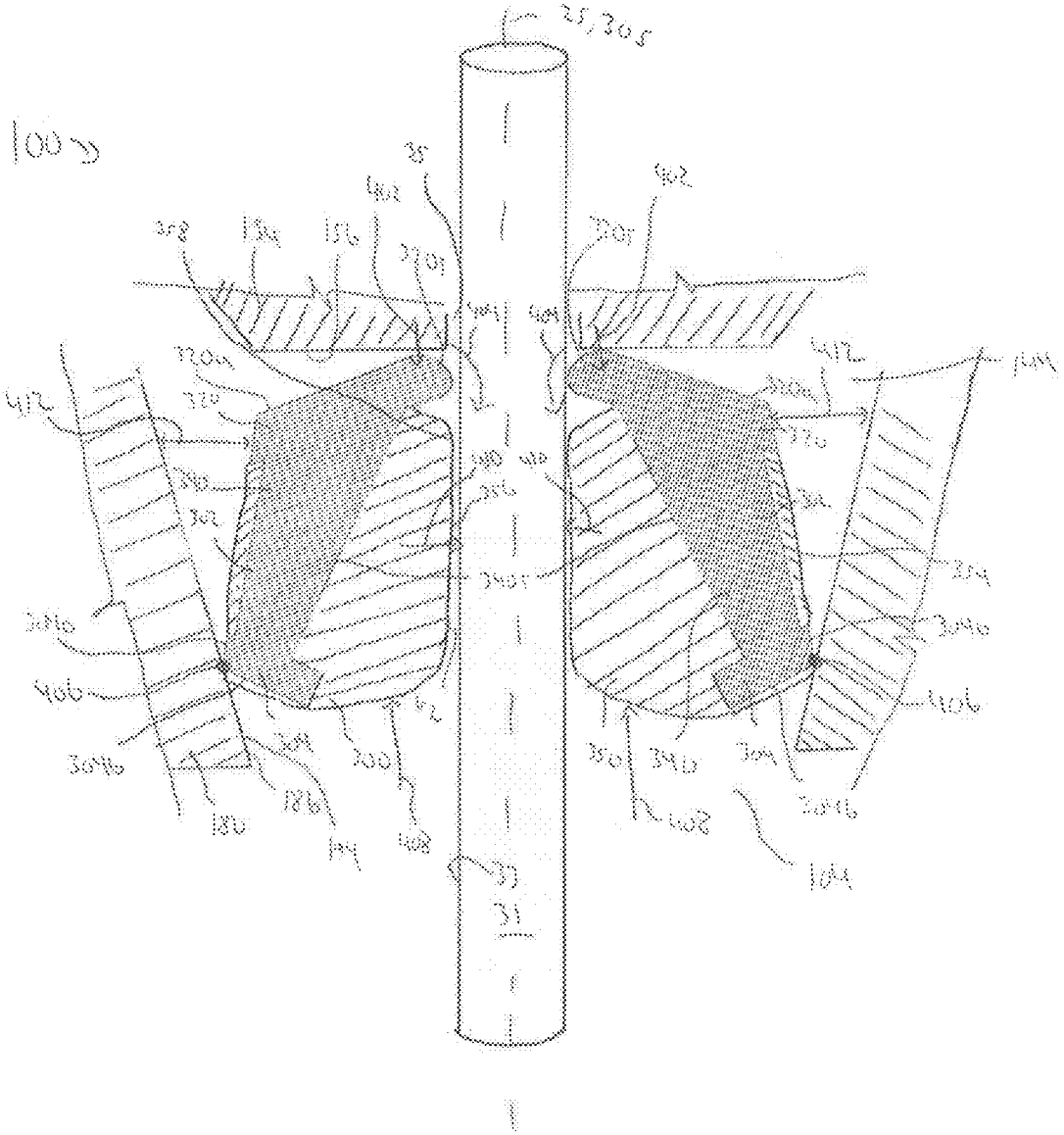
FIG. 7 is a schematic, cross-sectional view of the BOP of FIG. 2 disposed in a second position.

Referring to FIGS. 6 and 7, FIG. 6 schematically illustrates annular BOP 100 in the open position while FIG. 7 schematically illustrates BOP 100 in the closed position. As discussed above with reference to FIG. 2, annular BOP 100 may be actuated from the open position into the closed position via pressurizing closing chamber 200 while concurrently depressurizing opening chamber 202, thereby applying a closing pressure force 204 to piston 180. In response to the application of closing pressure force 204, piston 180 is displaced axially (i.e., parallel with longitudinal axis 25) through bore 104 of housing 102 towards the upper end 140*a* of top 140. As piston 180 is displaced axially upwards through bore 104 of housing 102, inclined surface 194 of piston 180 physically engages the outer surface 354 of the elastomeric body 350 of elastomeric packer 350. Specifically, physical engagement between piston 180 and packer 350 in response to the displacement of piston 180 through bore 104 of housing 102 results in the application of a piston force 400 (shown schematically in FIG. 6) to the outer surface 354 of elastomeric body 350. Given that both outer surface 354 of body 350 and inclined surface 194 of piston 180 are inclined or angled respective longitudinal axis 25, piston force 400 includes both an axially directed component (i.e., in a direction parallel with axes 25 and 305) and a radially inwards directed component (i.e., in a direction orthogonal with axes 25 and 305).

As piston 180 continues to travel upwards through bore 104 of housing 102, the radially inner end 320*i* of the upper flange 320 of each insert 302 contacts the lower annular surface 156 of wear plate 154, as shown in FIG. 7. In response to the physical engagement between wear plate 154 and inserts 302, a pivoting force 402 (shown schematically in FIG. 7) is applied to each insert 302 in a substantially downwards (i.e., in the direction of the lower end 102*b* of housing 102) axial direction. Particularly, pivoting force 402 is applied against each insert 302 at or proximal radially inner end 320*i* of upper flange 320, thereby applying a torque 404 (shown schematically in FIG. 7) against each insert 302. Torque 404 rotates each insert 302 about an axis of rotation 406 (shown extending into the page of FIG. 7) extending substantially orthogonal (but not intersecting) longitudinal axes 25, 305. Specifically, the axis of rotation 406 of each insert 302 extends approximately through the intersection of the lower end 304*b* and radially outer end 304*o* of the lower flange 304 of each insert 302, where this portion of the lower flange 304 of each insert 302 is engaged by the inclined surface 194 of piston 180. In this manner, inclined surface 358 of elastomeric body 350 is pivoted into sealing engagement against the outer surface 33 of drill pipe 31. Further, as the inner surface 352 of elastomeric body 350 physically engages the outer surface 33 of drill pipe 31, body 350 deforms, bringing cylindrical surface 356 into sealing engagement with the outer surface 33 of pipe 31. The sealing engagement provided by the inner surface 352 of elastomeric body 350, as well as the sealing engagement between outer surface 354 of body 350 and inclined surface 194 of piston 180, thereby seals or restricts fluid communication through annulus 35. Further, the inner surface 352 of elastomeric body 350 provides a sealing pressure 410 (shown schematically in FIG. 7) against the outer surface 33 of drill pipe 31 in response to physical engagement between body 350 and pipe 31.

As inserts 302 rotate about their respective axes of rotation 406, the radially inner end 320*i* of the upper flange 320 of each insert 302 is pivoted towards the outer surface 33 of drill pipe 31, such that the radially inner end 320*i* of each insert 302 physically engages or is disposed directly adjacent outer surface 33. The pivoting of inserts 302 produces a radial gap 412 extending between the outer end 320*o* of the upper flange 320 of each insert 302 and the inclined surface 194 of piston 180. In this position, elastomeric material comprising elastomeric body 350 is restricted from flowing or being extruded between the radially inner end 320*i* of inserts 302 and the outer surface 33 of drill pipe 31 in response to the application of a fluid pressure force 408 against the lower end 350*b* of body 350.

In some applications, annular BOP 100 may be actuated into the closed position in response to an increase in fluid pressure within wellbore 19 (shown in FIG. 1), where fluid pressure within wellbore 19 may be communicated to chamber 104 of housing 102. The increased pressure within chamber 104 thereby creates or increases a pressure differential across packer 300 when annular BOP 100 is actuated into the closed position. In traditional annular BOPs, an annular gap may extend between the radially inner end of each insert of the traditional packer and the outer surface of a drill pipe extending through the traditional annular BOP, allowing for elastomeric material of the packer to be extruded between the annular gap extending between the insert and drill pipe. The extrusion of elastomeric material in traditional BOPs reduces the amount of elastomeric material captured radially between the circumferentially positioned inserts and the outer surface of the drill pipe, reducing the amount of sealing pressure applied against the outer surface of the drill pipe by the elastomeric material.

Unlike traditional annular BOPs, the pivoting of the inserts 302 of packer 300 substantially reduces or eliminates the radial gap between the radially inner end 320*i* of the upper flange 320 of each insert 302 and the outer surface 33 of drill pipe 31, thereby trapping or substantially restricting extrusion of material comprising elastomeric body 350 radially between inner end 320*i* of each insert 302 and the outer surface 33 of drill pipe 31. Moreover, by trapping the elastomeric material of elastomeric body 350 radially between the circumferentially positioned inserts 302 and the outer surface 33 of drill pipe 31, packer 300 utilizes pressure force 408 to assist in increasing the sealing pressure 410 applied by elastomeric body 350 against pipe 31. Specifically, due to the rotation of inserts 302 when annular BOP 100 is actuated into the closed position, an inner surface disposed at the radially inner end 340*i* of the rib 340 of each insert 302 is disposed at an acute angle relative axes 25 and 305. In this arrangement, the pressure force 408 applied against elastomeric body 350 is reacted against the inner end 340*i* of the rib 340 of each insert 302, thereby translating the substantially axial pressure force 408 into a radially directed force against the outer surface 33 of drill pipe 31, increasing the sealing pressure 410 applied by elastomeric body 350 against pipe 31. Thus, instead of decreasing sealing pressure 410 as with traditional annular BOPs, the presence of a pressure differential across the upper and lower ends of packer 300 increases the sealing pressure 410 applied by elastomeric body 350 against the outer surface 33 of drill pipe 31.

While the operation of annular BOP 100 is described above in the context of sealing against the outer surface 33 of drill pipe 31, in other embodiments where drill pipe 31 does not extend through BOP 100, elastomeric packer 300 is configured to seal bore 144 of top 140 and bore 104 of housing 102 when BOP 100 is actuated into the closed position shown in FIG. 7. Particularly, when BOP 100 is disposed in the closed position and a tubular member, such as drill pipe 31, does not extend through BOP 100, the inner surface 352 of elastomeric body 350 seals against itself while outer surface 354 of body 350 seals against the inclined surface 194 of piston 180, thereby restricting fluid communication through bore 144 of top 140 and bore 104 of housing 102.

Figure 8:
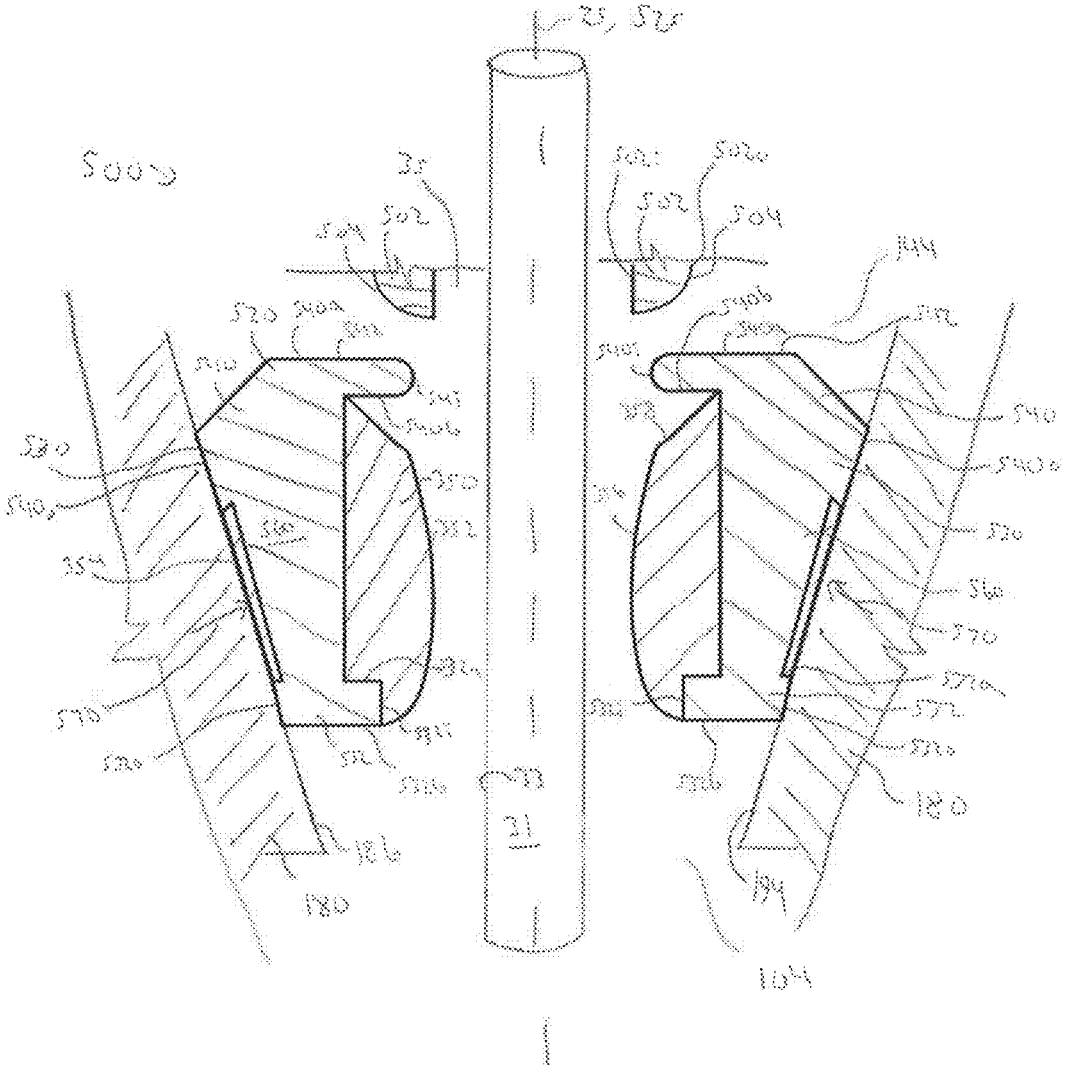
FIG. 8 is a schematic, cross-sectional view of another embodiment of a BOP disposed in a first position in accordance with principles disclosed herein.
Figure 9:
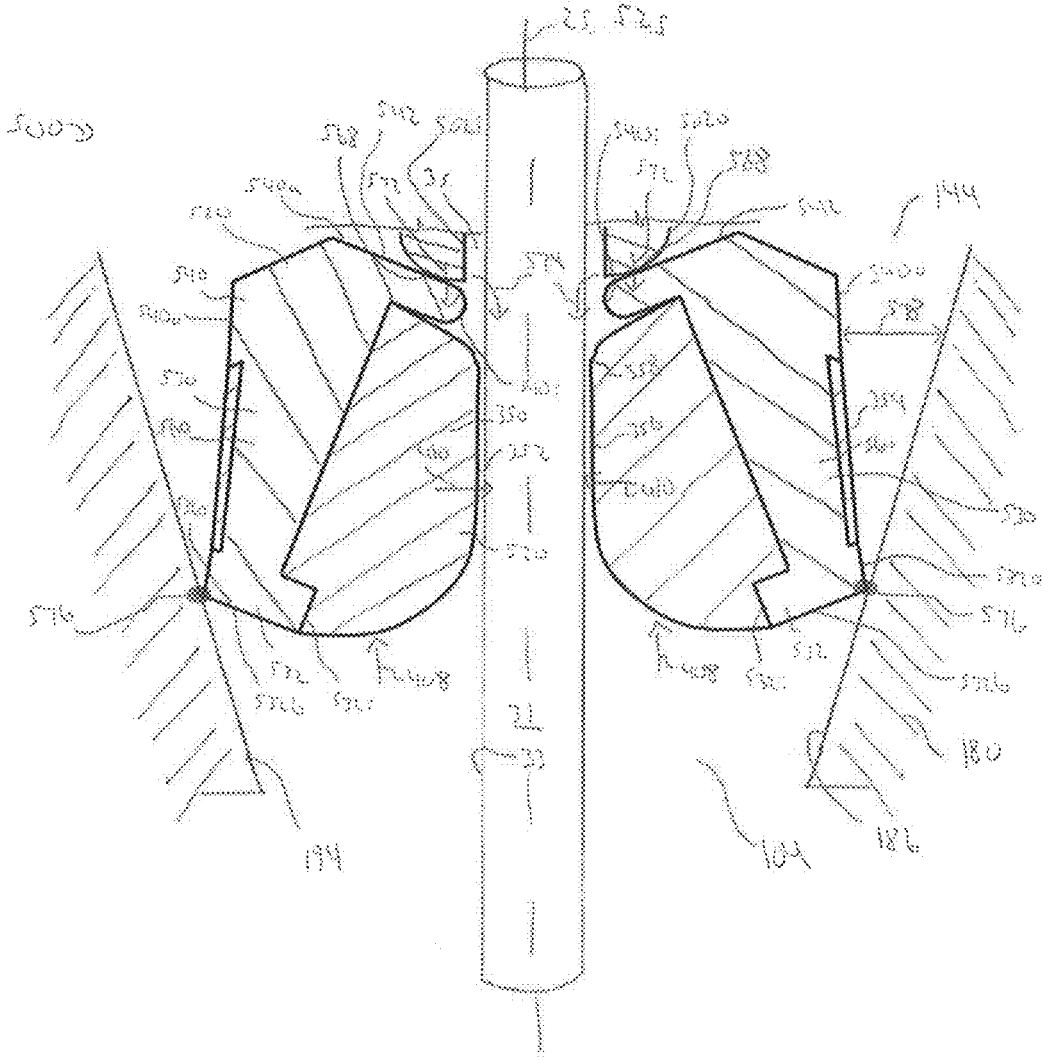
FIG. 9 is a schematic, cross-sectional view of the BOP of FIG. 8 disposed in a second position.

Referring to FIGS. 8 and 9, another embodiment of an annular BOP 500 is shown, where BOP 500 may be used in well system 10 shown in FIG. 1, or other well systems. Annular BOP 500 includes features in common with annular BOP 100 described above, and shared features are labeled similarly. Particularly, annular BOP 500 includes housing 102, top 140, and piston 180 of BOP 100. In the embodiment shown in FIGS. 8 and 9, annular BOP 500 further includes an annular wear plate 502 in lieu of wear plate 154 described above, and an annular elastomeric packer 520 in lieu of packer 300 described above. Wear plate 502 of annular BOP 500 includes an annular curved or angled lower surface 504. Specifically, wear plate 502 includes a radially inner end 502*i* and a radially outer end 502*o*, where curved surface 504 extends between inner end 502*i* and outer end 502*o*. While in this embodiment wear plate 502 has a curved lower surface 504, in other embodiments, wear plate 502 may include an inclined or angled planar surface. In other embodiments, wear plate 502 may comprise a flat or planar lower surface including a plurality of circumferentially spaced protrusions, where each protrusion includes a curved or angled surface configured to engage elastomeric packer 520. In some embodiments, wear plate 502 may be incorporated with top 140 to form a single unitary member.

In the embodiment of FIGS. 8 and 9, elastomeric packer 520 has a central or longitudinal axis 525 that is disposed substantially coaxial with longitudinal axis 25 and includes a plurality of circumferentially spaced inserts 530 coupled to elastomeric body 350. In certain embodiments, inserts 520 may be molded to elastomeric body 350 to form packer 520. Each insert 530 of elastomeric packer 520 includes a first or lower flange member 532, a second or upper flange member 540, and a rib member 560 extending between and coupling lower flange 532 and upper flange 540. Lower flange 532 of each insert 530 has a first or upper end 532*a*, a second or lower end 532*b*, a radially inner end 532*i*, and a radially outer end 532*o*. Upper flange 540 of each insert 530 has a first or upper end 540*a*, a second or lower end 540*b*, a radially inner end 540*i*, and a radially outer end 540*o*. In this arrangement, rib 560 extends between the lower end 540*b* of upper flange 540 and the upper end 532*a* of lower flange 532. In the embodiment shown, the upper end 540*a* of upper flange 540 includes a planar surface 542 that is disposed orthogonal the longitudinal axis 525 of elastomeric packer 520. Thus, orthogonal surface 542 of upper flange 540 is not inclined (i.e., disposed at an acute angle) relative longitudinal axis 305.

FIG. 8 schematically illustrates annular BOP 500 in a first or open position where fluid communication is provided through annulus 35, while FIG. 9 schematically illustrates BOP 500 in a second or closed position where fluid communication is restricted through annulus 35. As shown particularly in FIG. 8, as piston 180 is displaced through bore 144 of top 140 piston 180 applies piston force 570 to the outer surface 354 of elastomeric body 350 in an inclined direction respective longitudinal axis 525. As shown particularly in FIG. 9, as piston 180 continues to travel upwards through bore 144 of top 140 the upper end 540*a* of the upper flange 540 of each insert 530 contacts or physically engages the curved inner surface 504 of wear plate 502.

Due to an inclined or angled (i.e., disposed at a non-orthogonal angle relative longitudinal axis 525) engagement interface 568 formed between the inner surface 504 of wear plate 502 and the upper flange 540 of each insert 530, a pivoting force 572 (shown schematically in FIG. 9) is applied to each insert 530 in a substantially downwards axial direction is applied against each insert 530 in response to engagement with wear plate 502. Particularly, pivoting force 572 is applied against each insert 502 proximal the inner end 540*i* of upper flange 540, thereby applying a torque 574 (shown schematically in FIG. 9) against each insert 530. Torque 574 rotates each insert 530 about an axis of rotation 576 (shown extending into the page of FIG. 9) extending substantially orthogonal (but not intersecting) longitudinal axes 25 and 525. Specifically, the axis of rotation 576 of each insert 530 extends approximately through the intersection of the lower end 532*b* and radially outer end 532*o* of the lower flange 532 of each insert 532, where this portion of the lower flange 532 of each insert 530 is engaged by the inclined surface 194 of piston 180. The pivoting of inserts 530 produces a radial gap 578 between the outer end 540*o* of the upper flange 540 of each insert 530 and the inclined surface 194 of piston 180. In this manner, the inner surface 352 of elastomeric body 350 is pivoted into sealing engagement against the outer surface 33 of drill pipe 31. Further, similar to the operation of elastomeric packer 300 described above, due to the rocking action of inserts 530, the radially inner end 540*i* of the upper flange 540 of each insert 530 physically contacts or is disposed directly adjacent the outer surface 33 of drill pipe 31. In this arrangement, fluid pressure within bore 104 of housing 102 assists in increasing the sealing pressure of elastomeric body 350 against the outer surface 33 of drill pipe 31. Moreover, while annular BOP 500 is described above in the context of sealing against drill pipe 31, in other embodiments where a tubular member does not extend through BOP 500, the inner surface 352 of body 350 seals against itself when BOP 500 is disposed in the closed position to restrict fluid communication through the bore 144 of top 140.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A blowout preventer, comprising:

a housing comprising a bore extending therein;

an annular wear plate coupled to the housing;

an annular piston slidably disposed in the bore of the housing and comprising an inner surface; and an annular elastomeric packer disposed in the bore of the housing and in physical engagement with the inner surface of the piston, wherein the elastomeric packer comprises a plurality of circumferentially spaced inserts coupled to an elastomeric body;

wherein the blowout preventer comprises a first position providing fluid communication through the bore of the housing, and a second position restricting fluid communication through the bore of the housing, and wherein each of the plurality of circumferentially spaced inserts is spaced from the wear plate when the blowout preventer is in the first position;

wherein, in response to actuating the blowout preventer between the first and second positions, at least one of the plurality of circumferentially spaced inserts of the elastomeric packer pivots about an axis of rotation;

wherein, in response to actuating the blowout preventer from the first position to the second position, a radial gap is formed between an outer end of the at least one of the plurality of circumferentially spaced inserts and the inner surface of the piston.

2. The blowout preventer of claim 1, wherein the wear plate comprises an annular curved surface.

3. The blowout preventer of claim 2, wherein, when the blowout preventer is disposed in the second position, an angled engagement interface is formed between the at least one of the plurality of circumferentially spaced inserts of the elastomeric packer and the curved surface of the wear plate.

4. The blowout preventer of claim 1, wherein the wear plate comprises a radially inner end and a radially outer end, and wherein a curved surface of the wear plate curves between the radially inner and outer ends.

5. The blowout preventer of claim 1, wherein, when the blowout preventer is disposed in the second position, engagement between the wear plate and the at least one of the plurality of circumferentially spaced inserts applies a torque against the at least one of the plurality of circumferentially spaced inserts about the axis of rotation.

6. The blowout preventer of claim 1, further comprising:

a tubular member extending through the bore of the housing;

wherein, when the blowout preventer is disposed in the second position, a radially inner end of the at least one of the plurality of circumferentially spaced inserts contacts an outer surface of the tubular member.

7. The blowout preventer of claim 6, wherein, when the blowout preventer is disposed in the second position:

an inner surface of the elastomeric packer sealingly engages the outer surface of the tubular member; and a sealing pressure applied to the outer surface of the tubular member by the inner surface of the packer is increased in response to an increase in fluid pressure in the bore of the housing.

8. The blowout preventer of claim 1, wherein at least one of the plurality of inserts of the elastomeric packer comprises:

an upper flange extending between a radially inner end and a radially outer end;

a lower flange extending between a radially inner end and a radially outer end; and a rib extending between the upper flange and the lower flange.

9. The blowout preventer of claim 8, wherein the upper flange comprises an upper surface disposed at an acute angle relative a longitudinal axis of the elastomeric packer.

10. The blowout preventer of claim 8, wherein the upper flange of the at least one of the plurality of circumferentially spaced inserts comprises an upper end and a lower end, and wherein the radially inner end of the upper flange comprises a curved surface extending between the upper end and the lower end of the upper flange.

11. The blowout preventer of claim 8, wherein the upper flange of the at least one of the plurality of circumferentially spaced inserts comprises a longitudinal axis disposed at an acute angle relative to the longitudinal axis of the elastomeric packer.

* * * * *